United States Patent [19]

Johnson

[11] Patent Number: 4,523,162

[45] Date of Patent: Jun. 11, 1985

[54] MICROWAVE CIRCUIT DEVICE AND METHOD FOR FABRICATION

[75] Inventor: Arlen K. Johnson, New Providence, N.J.

[73] Assignee: AT&T Bell Laboratories, Murray Hill, N.J.

[21] Appl. No.: 523,146

[22] Filed: Aug. 15, 1983

[51] Int. Cl.[3] ..... H01P 1/205

[52] U.S. Cl. ..... 333/202; 29/600; 333/203; 333/204

[58] Field of Search ..... 333/202-212, 333/245, 248, 33; 29/600

[56] References Cited

U.S. PATENT DOCUMENTS

| | | | |
|---|---|---|---|
| 3,505,618 | 4/1970 | McKee | 333/203 |
| 3,818,389 | 6/1974 | Fisher | 333/203 |
| 4,037,182 | 7/1977 | Burnett et al. | 333/203 |
| 4,053,855 | 10/1977 | Kivi et al. | 333/208 X |
| 4,112,398 | 9/1978 | Burnett et al. | 333/203 |
| 4,271,399 | 6/1981 | Morita | 333/202 X |
| 4,410,868 | 10/1983 | Meguro et al. | 333/202 |
| 4,426,631 | 1/1984 | D'Avello et al. | 333/206 X |
| 4,431,977 | 2/1984 | Sokola et al. | 333/202 X |

FOREIGN PATENT DOCUMENTS

| | | | |
|---|---|---|---|
| 1199908 | 7/1970 | United Kingdom | 333/202 |

OTHER PUBLICATIONS

Wong-"Microstrip Tapped-Line Filter Design, IEEE, Trans. on Microwave Theory and Techniques", vol. MTT-27, No. 1, Jan. 1979; pp. 44-50.

Panasonic Industrial Company Data Sheets (Microwave Dielectric Duplexer and Microwave Bandpass Filter) (Numbered (010S) 83 5 on final page of each).

Electronics, Jul. 14, 1983, "Ceramic-filled Resonator Cuts Costs of Radio-Telephone Filters," T. Uwano, pp. 129-131.

*Primary Examiner*—Marvin L. Nussbaum

*Attorney, Agent, or Firm*—Charles S. Phelan

[57] ABSTRACT

Microwave devices are fabricated by a method wherein a block of dielectric material is conformed to the physical configuration of a required microwave device, and it is then coated with electrically conductive material. Portions of the coating material are removed from predetermined regions of the block to implement a predetermined microwave device. One microwave device fabricated in accordance with the foregoing method is shown, and comprises an interdigital bandpass filter in which the block is shaped and drilled with a line of parallel holes to define the physical configuration of an interdigital filter in which the interiorly-coated drilled holes comprise resonator rods within a microwave cavity formed by the exteriorly-coated remaining portions of the dielectric material block. Coating material is removed from end portions of the rods formed by the coated holes in order to fine-tune the filter to a desired center frequency in the band of operation.

11 Claims, 3 Drawing Figures

MICROWAVE CIRCUIT DEVICE AND METHOD FOR FABRICATION

BACKGROUND OF THE INVENTION

This invention relates to a method for manufacturing microwave circuit devices, and to a microwave electric filter manufactured in accordance with that method.

Microwave devices have typically been fabricated by manufacturing individual parts and assembling those parts. This is usually a costly operation, and products produced thereby are often rather bulky in size. Some examples in the interdigital, or comb-line, filter art are included in the following three patents. An R. E. Fisher U.S. Pat. No. 3,818,389 shows an interdigital filter arrangement for a microwave mixer in which two filter portions share a common output coupling element. Fine-tuning is accomplished by tuning screws extending through cavity walls toward interdigital, hollow, conductive resonator rods, or strip-line conductors. Conductive wall members are assembled to form a microwave cavity enclosing the resonator rods. A G. L. Burnett et al. U.S. Pat. No. 4,037,182 shows a microwave tuning device in which a tuning screw is inserted through an insulator ring in a cavity wall and into a recess in the end of a resonator rod. The ring physically stabilizes the end of the rod to eliminate a tuning fork effect. The rod recess increases the tuning range of the filter. This type of device is employed in a single comb-line filter in which the cavity walls which are parallel to the rods are spaced closely enough to suppress propagation modes higher than that employed for the filter. The rods are somewhat less than one-eighth of a wavelength in length. Rod diameter is determined by the requisite susceptance. Coaxial conductors are attached perpendicularly to end rods of a comb-line and provide input-/output functions. Another G. L. Burnett et al. Pat. No. 4,112,398 provides a lightweight microwave filter of the interdigital, or comb-line, type in which a lightweight, temperature-sensitive, metal cavity encloses resonator rods. Each rod is formed of two segments: a high-temperature-sensitivity segment and a low-temperature-sensitivity segment. The segments are proportioned so that thermal dimensional effects compensate, i.e., capacitance changes between rods and the cavity wall offset resonant frequency changes of the rods in response to temperature changes.

Dielectric materials are sometimes employed in microwave filters for various functions. For example, data sheets for the Panasonic Industrial Company microwave dielectric duplexer EYU D835C8801 and microwave bandpass filters EYU FOR835401 and EYU FOR880601, each includes a general statement that a dielectric coaxial resonator is employed. Also, an A. Kivi et al. U.S. Pat. No. 4,053,855 shows the employment of a dielectric material to fill the spaces among resonators in a resonant cavity filter for reducing the likelihood of multipacting in the filter.

SUMMARY OF THE INVENTION

The fabrication of microwave devices and, particularly, such devices involving resonant cavities, is facilitated by a method including the steps of (a) forming a block of dielectric material in the physical configuration of a required microwave device, (b) coating the entire block with a material which is electrically highly conductive compared to the conductivity of the dielectric material, and (c) removing portions of the highly conductive material from predetermined regions of the coated block to implement a predetermined electrical characteristic.

One device formed by the foregoing method is a bandpass filter comprising a block of dielectric material shaped and drilled to define the physical configuration of, for example, an interdigital filter. The drilled holes in the block are interiorly coated and comprise resonator rods within the microwave cavity formed by the electrically conductive, coated block. Coating material is removed at one selected intersection of each rod with a wall of the cavity, and the amount of material removed is determined to establish correct capacitance between the rod and the cavity end wall for establishing a desired center frequency of operation of the filter.

BRIEF DESCRIPTION OF THE DRAWING

A more complete understanding of the invention and the various features, objects, and advantages thereof may be obtained from a consideration of the following Detailed Description in connection with the appended claims and the attached drawing in which

DETAILED DESCRIPTION

Figure 1:
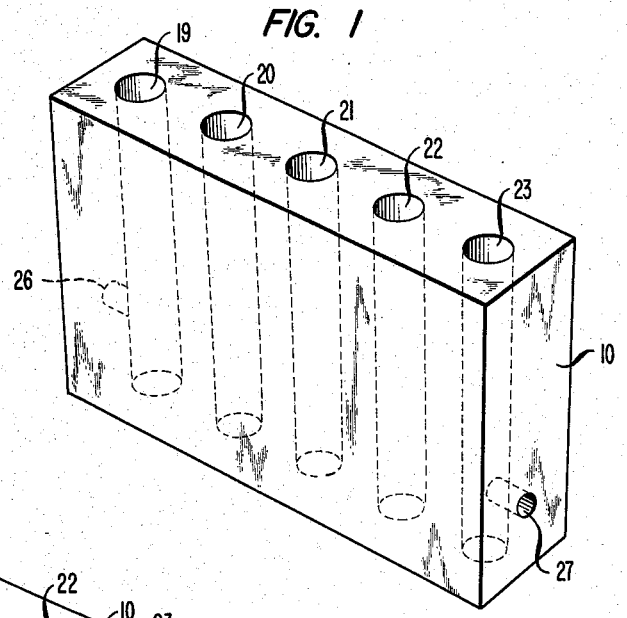
FIG. 1 is a perspective view of a dielectric material block used in the invention.
Figure 2:
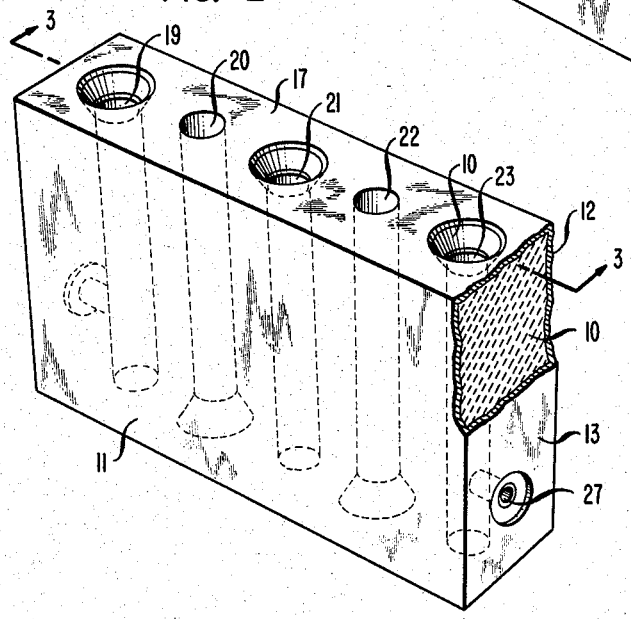
FIG. 2 is a perspective view of a microwave electric signal filter fabricated in accordance with the method of the present invention.
Figure 3:
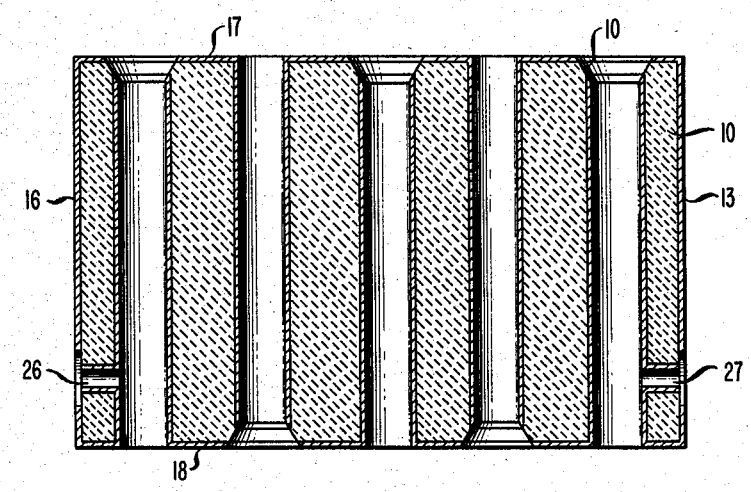
FIG. 3 is a cross-sectional view of the filter of FIG. 2 taken along the lines 3—3 in FIG. 2.

FIGS. 1, 2, and 3 depict different aspects of a microwave circuit device fabricated in accordance with the present invention. For purposes of illustration, that device takes the form of an interdigital bandpass filter for a frequency range of approximately 800 MHz to 900 MHz. However, the invention is not limited to that type of device, or to that frequency range. The device is formed, as earlier indicated herein, as a conductively-plated block 10 of dielectric material. The block is plated with a material, such as copper, having an electrical conductivity much higher than that of the block 10, to form a resonant cavity including, for example, the front and back walls 11 and 12 in FIG. 2. In that FIG., the filter is partially broken away in the upper right-hand portion thereof so that the plating comprising wall 12 on the rear side of the dielectric material block 10 can be seen. The front and rear walls 11 and 12 comprise portions of the ground plane for the filter. Plating also forms cavity end walls 13 and 16 comprising additional portions of the ground plane, along with plating forming the top and bottom walls 17 and 18, respectively. Holes 19–23, respectively, through block 10 accommodate plating material for comprising resonator rods of the filter. Holes 26 and 27 correct holes 19 and 23 to end walls 13 and 16, respectively, and accommodate additional plating material for coupling of input-/output coupling devices, as will be described, for connecting the filter into a suitable electric signal transmission facility. Either coupling hole can, alternatively, be placed in other locations such as one of the walls 11 or 12.

Turning now to a more detailed consideration of the various elements of the illustrative interdigital filter, the block of dielectric material 10 is advantageously a material such as barium titanate. The block is heat-treated, for example, in accordance with the teachings of the U.S.A. patent to H. M. O'Bryan, Jr., and J. Thomson, Jr., U.S. Pat. No. 4,337,446 in order to impart long-term temperature stability of dielectric constant and quality (Q) factor. Such dielectric material has a dielectric constant of approximately 40 and, therefore, contributes substantially to the size reduction of the filter illustrated, as compared to the size that would be required if the dielectric used in the filter were, for example, air. It is well known that the size reduction in a device is dependent largely upon the employment of a dielectric. Size is reduced by a factor of approximately the square root of the dielectric constant, i.e., in this case, reduced by a factor of approximately six.

The block 10 of dielectric material is conformed to a physical configuration suitable for an interdigital filter, as illustrated in FIG. 1; and, thus, it includes, as previously mentioned, the plurality of holes 19–23, respectively, for accommodating resonator rods, and holes 26 and 27 for accommodating input/output coupling devices. As shown in FIG. 1, the block 10 is rectangular with basically planar exterior faces and, hence, uniform cross-sectional area height and width between adjacent pairs of the holes 19–23. The number of holes for resonator rods, the diameter of those holes, spacings of the holes from each other and from end walls 12 and 16, and from ground plane walls 11 and 12, are generally determined in the usual way for interdigital filters to achieve approximately a desired frequency band for operation. However, the design procedure advantageously should be carried out so that holes 19–23 may be formed with like cross-sections, e.g., equal diameters. Although holes of circular cross-section are assumed for purposes of illustration, other shapes can also be employed. Dielectric material is plated through the holes to form the actual resonator rod.

The inside diameter of the hole in the dielectric material, i.e., the outside diameter of plating in the hole, is the resonator rod diameter. Furthermore, that diameter is advantageously selected to be a standard drill size for the facility in which the filter is to be manufactured. Other parameters of the filter are then adjusted accordingly. Although interdigital-type filters are typically illustrated as having resonator rods of equal diameters, that usually is not the case. The reason is that, once a designer has determined the required overall characteristics of the desired filter, such as the number of poles, it is then relatively easy to select capacitor values for the filter from a text book table of such values. Those values, in turn, determine resonator rod diameters which typically are different within a single filter and usually symmetrically distributed over an array of rods.

Different designers of microwave devices may follow different procedures for determining microwave device physical dimensions from the desired electric circuit characteristics of the device. However, in one procedure, it has been found to be convenient to employ teachings of two papers as aids in the procedure. These are "Exact Design of TEM Microwave Networks Using Quarter-Wave Lines," by R. J. Wenzel, *IEEE Transactions on Microwave Theory and Techniques,* January 1964, Vol. MTT-12, No. 4, pp. 94–111; and "Coupled Circular Cylindrical Rods Between Parallel Ground Planes," by E. G. Cristal, *IEEE Transactions on Microwave Theory and Techniques,* July 1964, Vol. MTT-12, No. 4, pp. 428–439.

The surface finish of the block 10 of dielectric material requires some attention. This surface must have sufficient roughness to enable adhesion of whatever plating is to be applied to the dielectric material. However, the surface must not be so rough as to cause undue electrical losses in regions of the filter where skin effect drives substantial electric current toward an interface region between the dielectric material and plating thereon. Such skin effect considerations, in fact, characterize the resonator rods of the filter in accordance with the illustrative embodiment, as well as much of the cavity wall enclosing the dielectric material. Adequate surface roughness is advantageously achieved in the illustrative embodiment by etching the block 10 for a sufficient time interval to roughen the surface without significantly removing a substantial amount of dielectric material. In one embodiment, a characteristic impedance at the aforementioned 50-ohm level was achieved with sufficient roughness to assure adhesion of copper plating.

Consideration of the location of the input/output coupling holes 26 and 27 in the block 10 is also advantageous. It is an object of that location consideration to locate those holes so that the impedance seen looking into a coupling port, or hole, is the same as that seen looking out from the port into a transmission line in which the resulting filter is to be connected. These input/output coupling holes 26 and 27 are advantageously located so that they are perpendicular to the longitudinal center line of the closest resonator rod, for example, the rods accommodated by the holes 19 and 23 in FIG. 1, and in the plane of the center lines of the rods of the array. The location of those coupling holes along the longitudinal center line of each closest resonator rod is advantageously made at an intermediate point between a short circuited zero impedance end of the rod and an open circuited infinite impedance end of the rod. That intermediate point is the one at which a matching impedance level, such as 50 ohms, is found.

The impedance matching point can, of course, be located experimentally by successive trial and error operations. However, it has been found convenient to determine the location initially by computer simulation, and confirm that location experimentally. In one illustrative embodiment, i.e., the one initially mentioned herein, the coupling holes 26 and 27 were each located at approximately 0.116 inches from the short-circuited end of the resonator rod, i.e., the outside face of bottom wall 18 of the cavity, to which they were coupled for a 50-ohm impedance match. The location of coupling ports in this fashion eliminated the need to add extra resonator rod sections to the filter, or to add other devices, for impedance transformation coupling. This type of feature in the filter further reduces the size and manufacturing cost of the device.

Once the dielectric material block 10 has been formed, as hereinbefore described, all surfaces of the block, both exterior surfaces of the block and interior surfaces of the mentioned holes of various types, are plated with an electrically conductive material having a substantially higher conductivity than that of the dielectric material. In the illustrative embodiment, copper was used for this purpose. However, other conductors, such as silver, are also suitable. In applying the plating, it has been found that an initial metallization layer is advantageously applied by standard techniques for electroplating plastics and other nonconductors. Then, the thickness of the conductor layer is built up to a suitable thickness by additional plating operations in a copper sulfate electrolyte. In copper, at the indicated frequency range of 800–900 MHz, the skin effect is found in approximately the outer 0.1 mil of the conductor material. Consequently, it has been found that a plating thickness of approximately five skin depths, i.e., 0.5 mil, provides a suitable compromise between the the losses in the material if the plating thickness is too thin, and the cost of extra material otherwise. It has been found that a plating thickness beyond five skin depths does not add appreciably to the reduction of electric circuit losses, but it adds considerably to the cost and weight of the conductive material being plated onto the dielectric body. It is recognized that, where skin effect is a factor, the use of a device configuration, in which the plating interface is in the skin effect region, gives rise to somewhat greater device insertion loss than would otherwise be the case. However, for many applications, such loss is an acceptable price to pay for the reduction in manufacturing cost which can be realized by the device construction method herein outlined.

Now, having plated the block 10, as just described, it is useful to proceed to a consideration of the step of fine-tuning the microwave device represented by the interdigital filter in the illustrative embodiment. The fine-tuning is accomplished in order to place the filter operation at the desired center frequency. This fine-tuning is done by removing the electrically conductive plating material from appropriate regions of the microwave device to produce the desired tuning effect. For the interdigital filter of the illustrative embodiment, the material removal is carried out at one end of each of the resonator rods where that rod intersects either the top cavity wall 17 or the bottom cavity wall 18 for the respective rods in order to achieve the interdigital effect. In FIG. 2, the removal region is at the top wall 17 for the rods in the holes 19, 21, and 23, and in the bottom cavity wall 18, for the rods 20 and 22. Thus, the material removal in the manner described forms the open-circuited end of the resonator rod where the material is removed, and leaves the other end of the rod short-circuited to the ground plane of the cavity wall.

Plating material removal is advantageously achieved by drilling the appropriate end of the plated hole with an over-sized drill. For example, in the case of a filter having holes 5/32" diameter, an over-sized drill of, for example, 9/32" is utilized to countersink the holes and, thereby, remove plating material from both the inside of the hole and the outside wall of the cavity around the intersection region of the hole with the cavity wall. By alternately drilling and applying a frequency sweep test signal to the filter, the removal is effected to achieve the desired resonant frequency for each of the resonator rods, respectively.

In the illustrative embodiment described herein, it has been found that, when an electrical connection between a resonator rod end and the cavity wall is just broken, a resonant frequency of approximately 795 MHz is realized. As additional plating material is removed by deeper countersinking or reaming, that resonant frequency is shifted upward as the resonator rod becomes shorter. For filters of the approximate shape illustrated, tuning has been effected to as high as about 1200 MHz without producing an indication that such was a limit. In removing plating material for tuning purposes, it is desirable to remove little, if any, plating material from the associated top or bottom wall 17 or 18 so that the effectiveness of that wall in the overall ground plane function is not substantially reduced. Each of the resonator rods is so tuned in succession, for example, from the input resonator rod in hole 23 to the output resonator rod at the hole 19, until the filter has been tuned.

In order to facilitate the connection of the filter in an electric circuit, or transmission line, additional cavity wall plating material is removed, e.g., by reaming, out of each end wall at the intersection of its coupling hole with the cavity wall in order to break the electrical connection between the in-hole plating at that point and the cavity end wall, e.g., 13 or 16, as appropriate. This reaming operation is accomplished with a sufficient diameter to provide adequate clearance for accomplishing an electrical connection between a coaxial coupling device (not shown) center conductor and the conductive plating material within the coupling hole 26 or 27 without touching the surrounding cavity wall plating material.

The plated and fine-tuned filter member is then advantageously secured to a ground plane printed wiring board (not shown) in order that it may be mounted in appropriate utilization equipment. For this purpose, the filter is oriented so that, for example, one of its wide ground plane walls 11 or 12 is face to face with a plated ground plane on the printed wiring board and secured in contact with the printed wiring board in that fashion, for example, by soldering selected corner points or by otherwise firmly securing the two members in facial contact. Then, in coaxial coupler is mounted to the printed wiring board; and its shield connecting member is electrically connected to the board ground plane plating and, hence, to the cavity ground plane walls. Similarly, the coaxial coupler center conductor is electrically connected to the plating inside the coupling hole and, thereby, to the adjacent resonator rod outer surface, i.e., the plating interface surface of the resonator rod. The electrical connection to the coupling hole plating is preferably achieved at the exposed edge portion thereof after the reaming operation to be sure that good electrical connection is achieved to the plating interface side of the coupling hole plating and thereby provide the minimum electrical path length for the currents in the presence of skin effect. Plural filters also can be stacked or otherwise arrayed with ground plane walls such as 11 or 12 in contact.

Although the present invention has been described in connection with a particular embodiment thereof, it is to be understood that additional applications, modifications, and embodiments, which will be apparent to those skilled in the art, are included are included within the spirit and scope of the invention.

What is claimed is:

1. A method for fabricating an electric signal bandpass filter and comprising the steps of shaping a block of dielectric material to the configuration of a resonant cavity in a frequency range of operation for said bandpass filter and having plural holes therethrough, each having a center line intersecting two faces of said block, said holes being parallel to one another and having their center lines in a plane, and said block having in each region between any pair of adjacent holes a substantially uniform cross-sectional area in a direction perpendicular to said plane, said area being selected in relation to diameters of said holes for establishing a predetermined bandwidth for said filter, coating surfaces of said block with a material which is electrically highly conductive compared to the electrical conductivity of said dielectric material, and removing portions of said highly conductive material from a region at an intersection of each of said holes with a surface of said block to tune said filter to a predetermined frequency.

2. The filter fabricating method in accordance with claim 1 in which said shaping step comprises the steps of forming each of said holes to a common predetermined diameter, and forming external dimensions of said block to accommodate spacing of said holes with respect to one another and with respect to sides and ends of said block to establish said predetermined bandwidth for said filter.

3. The filter fabricating method in accordance with claim 1 in which said removing step comprises the step of countersinking each of said holes in said intersection region to tune said filter.

4. An electric signal filter comprising a block of dielectric material having a plurality of holes therethrough each having a center line intersecting two faces of said block, said holes being parallel to one another and having their center lines in a plane, said block having substantially uniform width and height through each of its regions between a pair of adjacent ones of said holes, said width and height being proportioned in relation to diameters of said holes to establish a predetermined bandwidth for said filter, and electric signal conductive material coated over outer and inner surfaces of said block, except in a predetermined region comprising an intersection of each of said holes with one of said faces, said excepted intersecting region being dimensioned to determine fine-tuning of said filter, said material having an electrical conductivity which is much larger than the conductivity of said dielectric material.

5. The electric signal filter in accordance with claim 4 in which means are provided for establishing a predetermined impedance for said filter, and said establishing means comprising a conductively coated coupling aperture extending through said block from an outer surface thereof to one of said holes at a point along the length of such hole selected to realize said predetermined impedance, the aperture coating providing electric circuit access to an interiorly plated surface of said one hole.

6. The electric signal filter in accordance with claim 4 in which said plurality of holes are all of substantially the same cross-sectional configuration in a cross-section perpendicular to a longitudinal axis thereof.

7. The electric signal filter in accordance with claim 4 in which said plurality of holes are all of circular cross section of substantially the same diameter and, each of said holes has a countersink configuration in said intersecting region.

8. The electric signal filter in accordance with claim 4 in which each of said holes has a circular cross-section of a single diameter which is a standard drill size.

9. The electric signal filter in accordance with claim 8 in which at least one signal coupling means is provided and comprises an interiorly-coated aperture in said block and extending through said block material to one of said plurality of holes, said aperture being located at a point along said one hole selected to fix the characteristic impedance of said filter, and the interior coating in said aperture and the outer surface coating on said block being electrically discontinuous at the intersection of said aperture and said block outer surface.

10. The electric signal filter in accordance with claim 4 in which said dielectric material is barium titanate, and said electric signal conductive material coating said block is copper.

11. The electric signal filter in accordance with claim 10 in which said coating material has a thickness approximately equal to five skin-depth thicknesses at a passband center frequency of operation of said filter.

* * * * *